US009273466B2

(12) United States Patent
Anglade

(10) Patent No.: US 9,273,466 B2
(45) Date of Patent: Mar. 1, 2016

(54) SELF SUPPORTING COMMUNICATION TOWER

(71) Applicant: Carlos Anglade, Doral, FL (US)

(72) Inventor: Carlos Anglade, Doral, FL (US)

( * ) Notice: Subject to any disclaimer, the term of this patent is extended or adjusted under 35 U.S.C. 154(b) by 0 days.

(21) Appl. No.: 14/450,266

(22) Filed: Aug. 3, 2014

(65) Prior Publication Data

US 2016/0032588 A1 Feb. 4, 2016

(51) Int. Cl.

| | |
|---|---|
| ***E04C 3/02*** | (2006.01) |
| ***E04B 1/343*** | (2006.01) |
| ***E04B 1/58*** | (2006.01) |
| ***E04H 12/24*** | (2006.01) |
| ***E04H 12/34*** | (2006.01) |
| *E04H 12/00* | (2006.01) |

(52) U.S. Cl.

CPC ..... *E04C 3/02* (2013.01); *E04B 1/34326* (2013.01); *E04B 1/34384* (2013.01); *E04B 1/5825* (2013.01); *E04H 12/24* (2013.01); *E04H 12/342* (2013.01); *E04B 2001/5887* (2013.01); *E04H 2012/006* (2013.01)

(58) Field of Classification Search

CPC ..... E04B 1/34; E04B 1/3404; E04B 1/34384; E04B 1/34326; E04B 1/5825; E04B 2001/5887; E04H 12/06; E04H 12/08; E04H 12/00; E04H 12/342; E04H 2012/006; E04C 3/02

USPC ..... 52/633, 648.1, 651.01, 651.07, 652.1, 52/653.2, 843, 656.9, 650.1

See application file for complete search history.

(56) References Cited

U.S. PATENT DOCUMENTS

| | | | | | |
|---|---|---|---|---|---|
| 1,676,161 | A | * | 7/1928 | Schiller et al. | 52/40 |
| 1,705,104 | A | * | 3/1929 | Woodruff et al. | 52/651.02 |
| 1,937,964 | A | * | 12/1933 | Jenner | 343/829 |
| 2,709,975 | A | * | 6/1955 | Brooks | E04B 1/19 403/172 |
| 2,806,560 | A | * | 9/1957 | Cox | 52/637 |
| 2,875,865 | A | * | 3/1959 | Rohn | 52/116 |
| 3,020,985 | A | * | 2/1962 | Turner | 52/148 |
| 3,302,345 | A | * | 2/1967 | Ballantine | 52/121 |
| 3,368,319 | A | * | 2/1968 | Maxime et al. | 52/637 |
| 3,634,989 | A | * | 1/1972 | Rogers | 52/651.09 |
| 3,670,471 | A | * | 6/1972 | Smith | 52/638 |
| 3,727,362 | A | * | 4/1973 | Ellison et al. | 52/650.1 |

(Continued)

*Primary Examiner* — Brent W Herring

(57) ABSTRACT

A skeleton triangular tower frame structure comprising a series of vertical, horizontal and diagonal tubular members with flattened ends, joined together by means of threaded rods or studs, washers and nuts. Every three (3) vertical tubular members joined to three (3) horizontals and to three (3) diagonals, make a section which is connected to a similar section placed on a top level. There are as many sections as the tower require as per specific design. The length, diameter and thickness of the tubular members are determined by structural calculations for a given tower design loads and height. The three (3) horizontal tubular members conform an equilateral triangle of bigger section at the bottom portion of the tower and is reduced as the tower gets higher in a tapered manner. The first section of the tower is supported by a wider base formed by a tetrahedral frame for additional stability. The tubular tower members are delivered to the job site in separate short pre-manufactured members with studs, washers and nuts for easy transportation.

In constructing the tower, a removable platform is placed on top of the three horizontal members that form the equilateral layer, where the erection crew can stand up to interconnect the upper sections. This procedure continues until the self-supporting tower reaches its total height, making the use of cranes or any other elevating equipment unnecessary.

6 Claims, 10 Drawing Sheets

(56) References Cited

U.S. PATENT DOCUMENTS

| | | | | | |
|---|---|---|---|---|---|
| 3,925,942 | A * | 12/1975 | Hemmelsbach | E04B 1/3205 135/122 |
| 4,184,084 | A * | 1/1980 | Crehore | 290/55 |
| 4,745,412 | A * | 5/1988 | Creaser, Jr. | 343/890 |
| 5,649,402 | A * | 7/1997 | Moore | 52/651.02 |
| 5,700,102 | A * | 12/1997 | Feleppa | 403/170 |
| 5,802,772 | A * | 9/1998 | Burke et al. | 52/6 |
| 6,026,627 | A * | 2/2000 | Moore | 52/651.02 |
| 8,471,396 | B2 * | 6/2013 | Roddier et al. | 290/44 |
| 8,534,025 | B2 * | 9/2013 | De Abreu | 52/651.01 |
| 8,739,492 | B2 * | 6/2014 | Hawkins et al. | 52/653.1 |
| 9,038,348 | B1 * | 5/2015 | Fang et al. | 52/651.01 |
| 2004/0128940 | A1 * | 7/2004 | LaForge | 52/655.1 |
| 2008/0127595 | A1 * | 6/2008 | Reynolds et al. | 52/653.2 |
| 2009/0249707 | A1 * | 10/2009 | Curme | 52/40 |
| 2010/0162652 | A1 * | 7/2010 | Croes | 52/651.01 |
| 2010/0326007 | A1 * | 12/2010 | Silber | 52/741.4 |
| 2011/0037264 | A1 * | 2/2011 | Roddier et al. | 290/44 |
| 2011/0146192 | A1 * | 6/2011 | Foss | 52/651.01 |
| 2011/0283640 | A1 * | 11/2011 | Miller | 52/292 |

* cited by examiner

FIG. 3.1
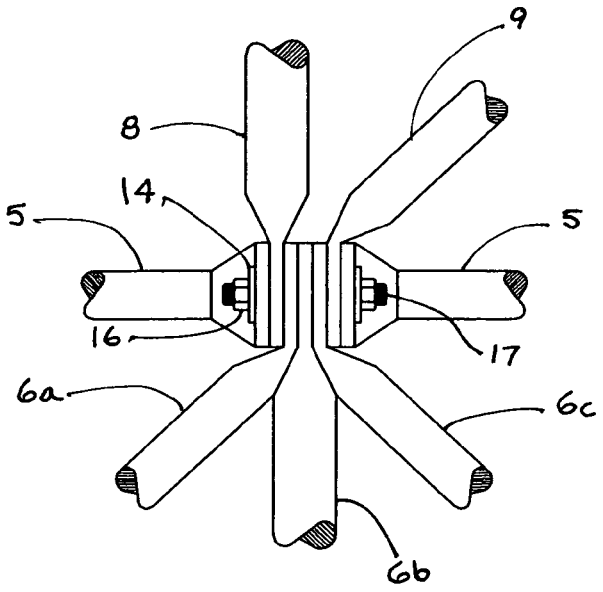
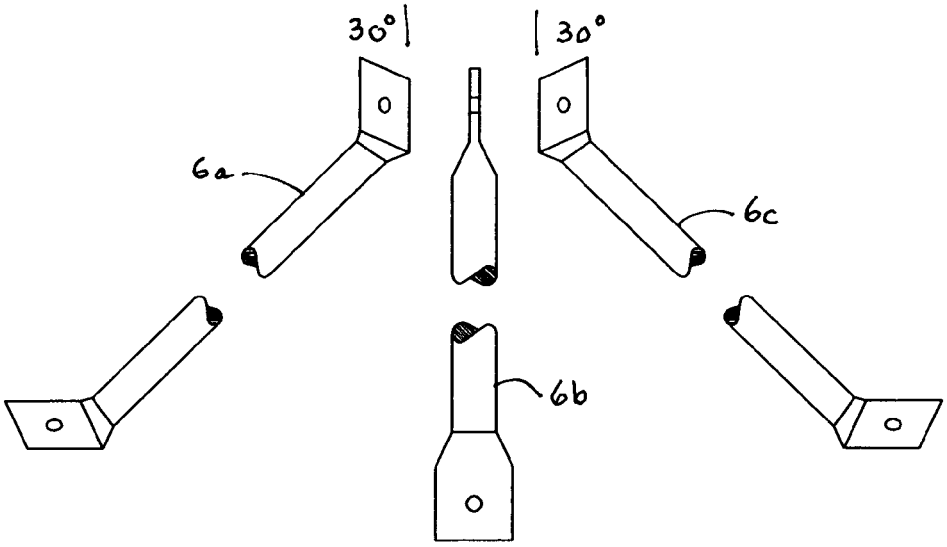

FIG. 3.2
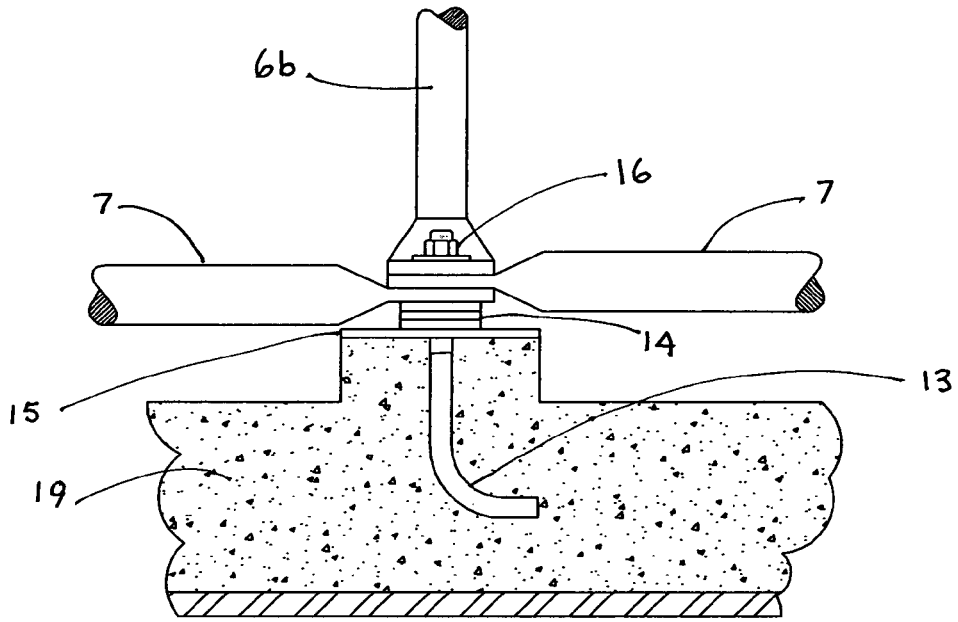

FIG. 3.3
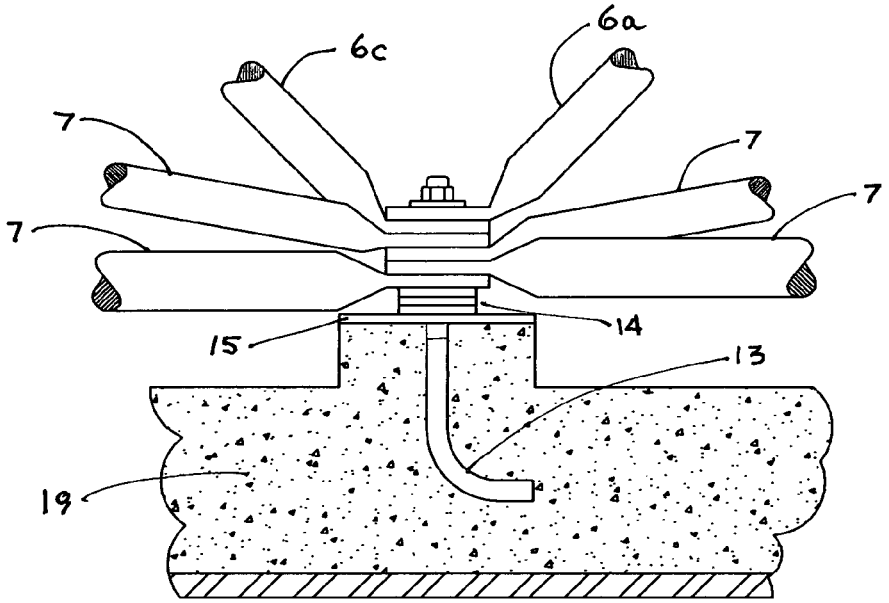
FIG. 3.4
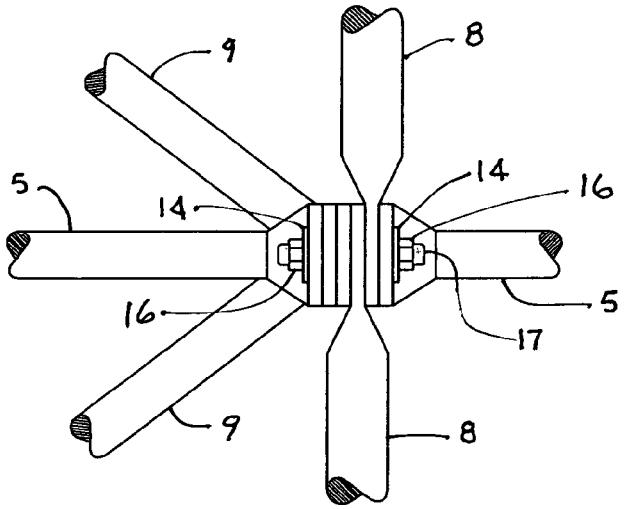

SELF SUPPORTING COMMUNICATION TOWER

BACKGROUND OF THE INVENTION

The invention resides in an in-situ erected self-supporting communication tower constructed by means of interconnecting short tubular members through their flattened and pierced ends with studs washers and nuts that conform a node which is connected to other nodes in such a manner, that, as a whole, forms a tower of a desired height, capable of holding the necessary communication equipment. The invention utilizes short members capable of being hand-held by operators during the construction and erection process.

Prior-art towers are generally constructed with structural steel angles or tubular members welded or bolted together into several sections of about 20 feet long each, which are hot-dipped galvanized after fabrication and are transported to the tower's chosen location where they are connected and put in place with the help of a crane or other elevating apparatus.

In the communication industry, the service providers must maintain a network of towers spread across their coverage area. The location of towers could be in remote places with hilled terrain of difficult access by regular transportation means to move the voluminous pre-fabricated tower section.

The present invention greatly facilitates fabrication, transportation, erection, service and maintenance reducing overall cost, making the invention a good product to be used by the increasing worldwide communication industry.

SUMMARY OF THE INVENTION

The present invention is a frame structure constructed by means of interconnecting vertical, horizontal and diagonal elements by their ends, forming a self-supported communication tower of triangular section. The elements may be steel bars, pipes, tubing, beams, angles, carbon fiber pipes or tubing, or any other convenient structural member. For the illustrations and description of the present invention, aluminum tubular members with their ends flattened are used because of their added advantage of light weight, ease of transportation and erection and corrosion resistance. It is particularly advantageous, according to the invention, that the tower is erected in situ as several single tubular elements which are interconnected and bolted together form a layer where the installing operator can place a removable platform, resting on the finished section, to install the next staggered upper section.

BRIEF DESCRIPTION OF THE DRAWINGS

FIG. 3. Shows the 4 types of Nodes that comprise the tower each described in FIG. 3.1; FIG. 3.2; FIG. 3.3 and FIG. 3.4.

DETAILED DESCRIPTION

The invention will be described in great detail with certain degree of particularity and referring primarily on the use of aluminum tubes flattened at their ends, bended at certain angles and bolted together to form a tower. It is clear that many changes may be made, especially in the selection of the elements, bars, tubes structural steel angles, beams; and also in details of arrangements and construction sequence. This should not depart from the spirit and scope of the invention.

Figure 1:
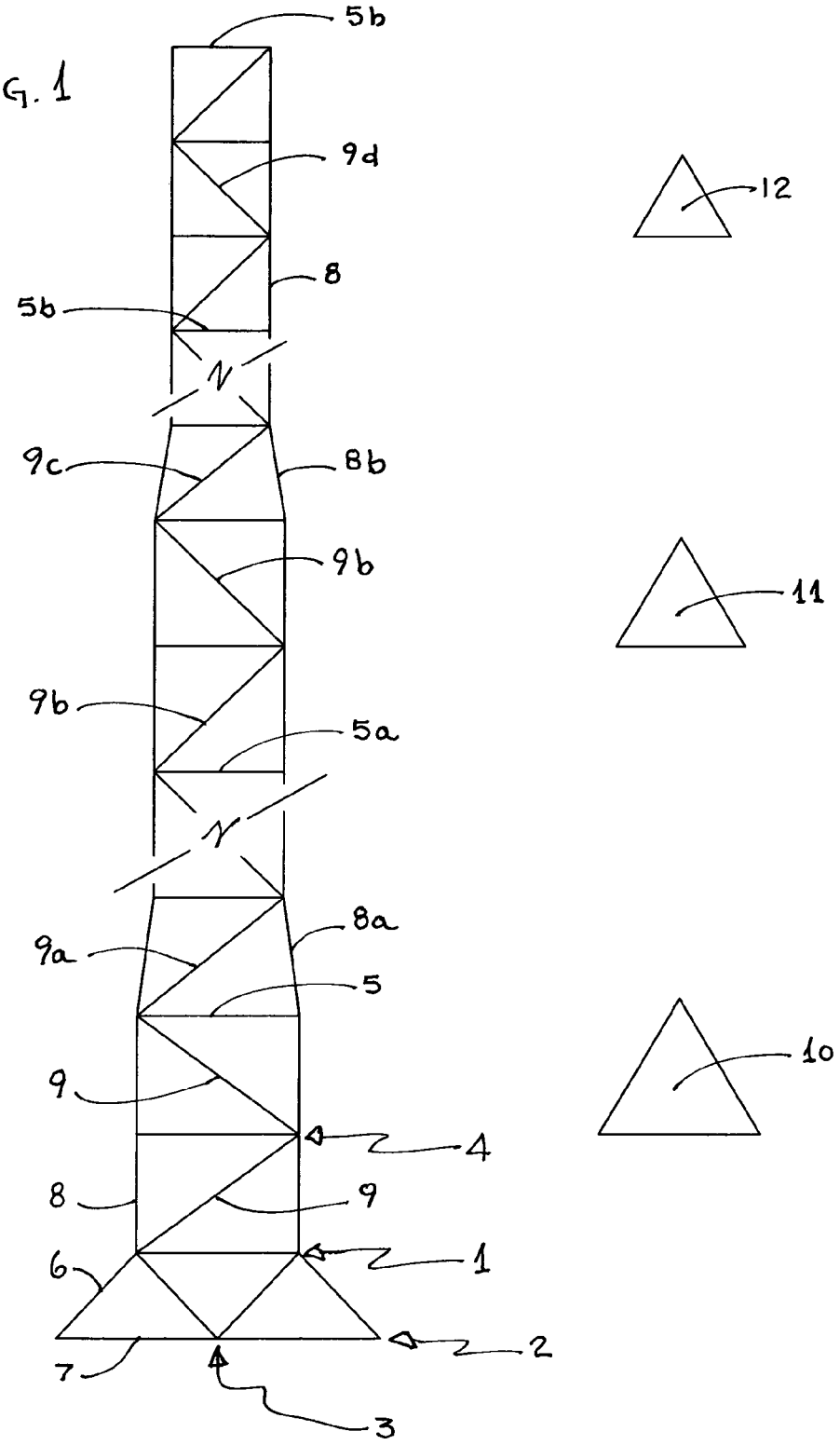
FIG. 1. Is an elevation of the tapered Tower indicating by pointing arrows the 4 types of Nodes, and different types of elements.

FIG. 1. Shows an elevation of a three tapered sections tower #10,11,12 whose dimensions, height and sections will be determined by the specific structural calculation to support the loads required for its final use. For high towers the base and foundation is a six (6) fixed points as shown on FIG. 1, and FIG. 7. For shorter towers the foundation could only be a three (3) fixed points at level 1 of the elevation drawing on FIG. 1. To differentiate Nodes from element members, Nodes are shown on FIG. 1, with a numbered pointing arrow from 1 to 4.

Figure 2:
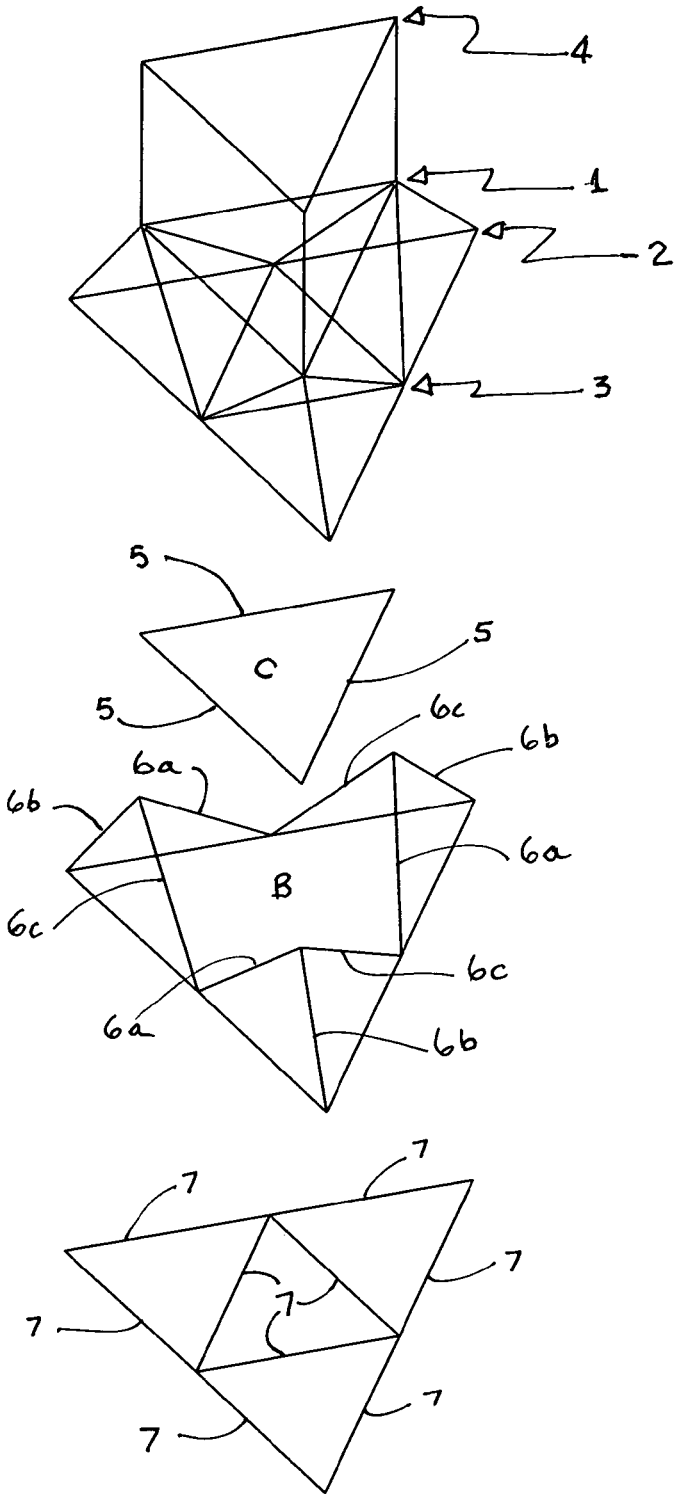
FIG. 2. Is an isometric view of the tetrahedral base footing of the tower depicting 3 layers.

FIG. 2. Is an isometric drawing of the tetrahedron footing section of the tower and its connection to the first triangular section. As indicated on FIG. 2, layers have been defined for better understanding. Layer "A" is the base of the tetrahedron that is connected to the concrete foundation footing. Layer "B" shows the diagonal tubular elements of the tetrahedron on top of which layer "C" is connected and constitutes the first level of the vertical tower. The isometric drawing on FIG. 2 is marked with numbers 5,6,7 to facilitate viewing. The number 7, are the nine (9) bottom tubular members of layer "A"; the number 6 are the nine (9) diagonal tubular members of layer "B" and the number 5 are the three (3) members of layer one "C".

FIGS. 3. are detailed drawings of the four (4) different Nodes of the tower. All Nodes are formed by connecting several members together by their flattened end portion which have bored or punched holes so as to accommodate studs inserted therein.

FIG. 3.1 is a detailed drawing of Node 1 showed in FIG. 1 and FIG. 2. There are three (3) Nodes number one (1), located at the connection of the triangular vertical section of the tower with the tetrahedral base. Node 1 is formed by seven (7) tubular elements fastened together at their flattened ends by means of one (1) stud, two (2) washers and two (2) nuts. This is the only Node that joints together seven different elements: a vertical tower leg #8, two horizontal bracing elements #5, three tetrahedral elements #6*a*,6*b*,6*c* and one diagonal anti-torsion element #9. To fastened the elements studs are used because they permits the connection of elements coming from both sides; while head bolts need to receive elements from one side only making it more difficult to assemble a Node. Note that the studs on the vertical section of the tower are horizontally oriented, while on the tetrahedral base bolts are vertically oriented; therefore, a transition is made as shown on the details drawings of the tetrahedral diagonal tubular members numbered 6*a*,6*b*,6*c*. Elements 6*a* and 6*c* have the flattened ends rotated 30 degrees and element 6*b* has the flattened end rotated 90 degrees in order to make the transition from horizontal oriented tower studs to vertical studs of the footing connection.

FIG. 3.2. Is a detail drawing of Node 2 as shown on FIG. 1 and FIG. 2. There are three (3) Nodes number two (2), located at the bottom of the tetrahedron external base and are formed by three (3) tubular members: two (2) horizontal #7 and one (1) diagonal #6*b*, joined together by the stainless steel anchor bolt #13 embedded in the concrete base footing. To prevent cathode corrosion a stainless steel bearing plate #15 is used to separate the aluminum tubing from the concrete as shown on FIGS. 3.2 and 3.3. Also, aluminum washers are used to assure a leveled base.

FIG. 3.3 is a detailed drawing on Node 3. There are three (3) Nodes number three (3), located at the bottom of the tetrahedral base, and are formed by six 6 tubular members: four (4) horizontal #7 and two (2) diagonals #6*a* and 6*c*; also joined together by stainless steel anchor bolt #13 attached to the bearing plate with washers in the same fashion as Node 2.

In order to assure a level plane at layer "A", see FIG. 2. and FIG. 3.2. supplemental washers #14 are placed at the bottom of the connection between the tetrahedral base and the foundation anchor bolts #13 in all three (3) Nodes. (1,2,3).

FIG. 3.4. Is a detailed drawing of Node 4. There are three (3) Nodes number four (4) per level of the vertical tower, see FIG. 1, consisting of six (6) tubular elements: two (2) vertical #8, called vertical legs; two (2) diagonals #9 called anti-torsion diagonals, and two (2) horizontal #5 called horizontal bracing, all tubular members. This type of Node is repeated through all levels of the tower.

Figure 4:
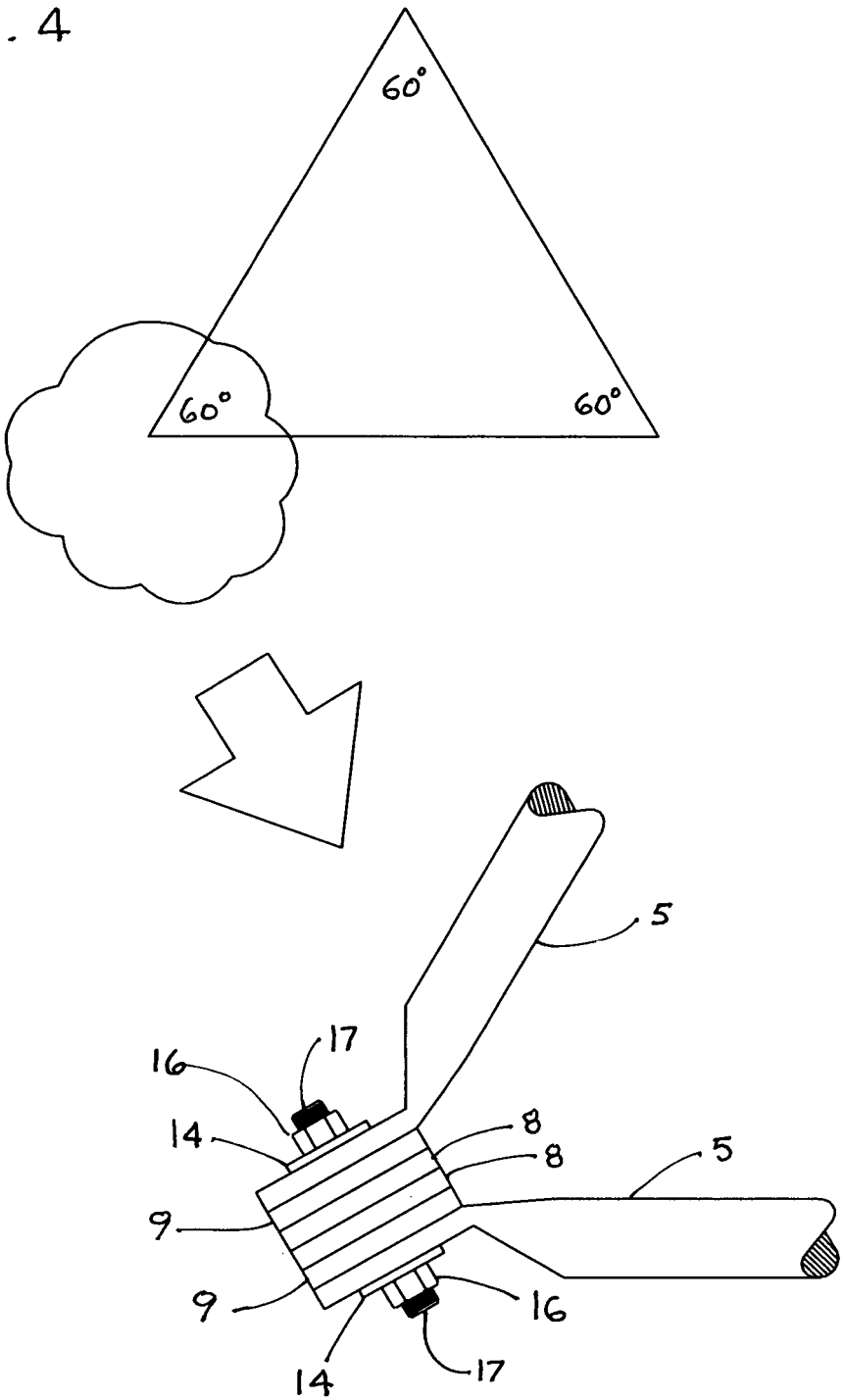
FIG. 4. Shows the equilateral bracing tubular elements of the tower.
Figure 5:
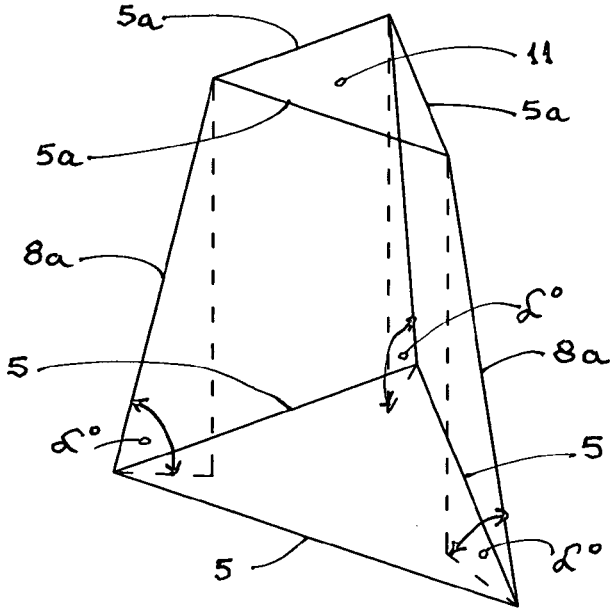
FIG. 5. Is a typical tapering section.

FIG. 4. shows a cross section of the three (3) horizontal bracing elements #5 that form the equilateral section of the tower by joining together two vertical legs #8, two anti-torsion diagonals #9 with two horizontal bracing elements #5. It is of great importance to connect symmetrically all the elements as shown on FIG. 4. At center two #8, bracing them two #9 and bracing them two #5. Depending on the specific tower dimensions there may be tapered sectors, (see FIG. 5) which are formed by interconnecting a larger equilateral triangle section with a smaller upward triangle section by means of three (3) vertical legs members #8*a* which are tilted inward to a small angle as shows on FIG. 5.

Figure 6:
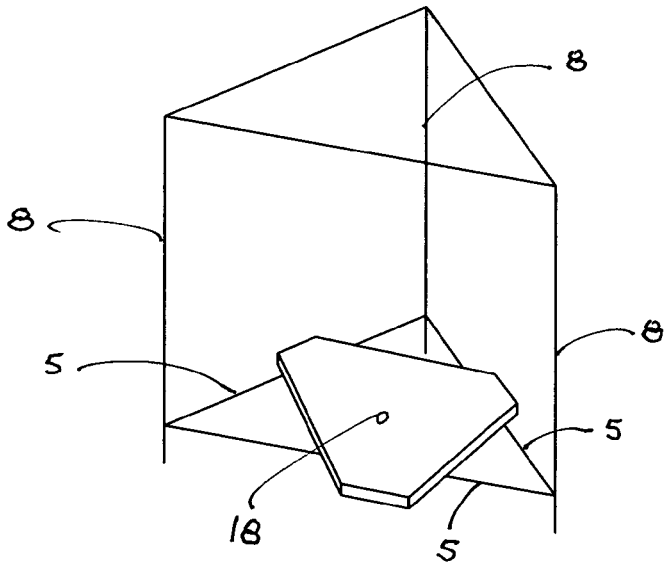
FIG. 6. Shows the erection platform
Figure 7:
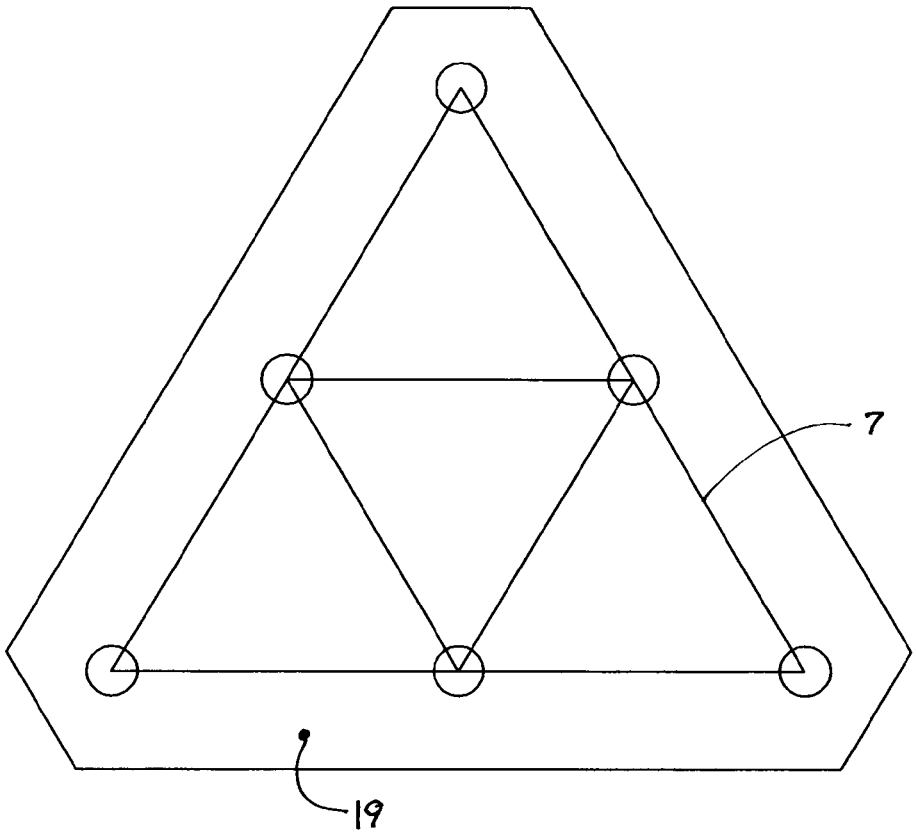
FIG. 7. Is a plan view of the concrete foundation.
Figure 8:
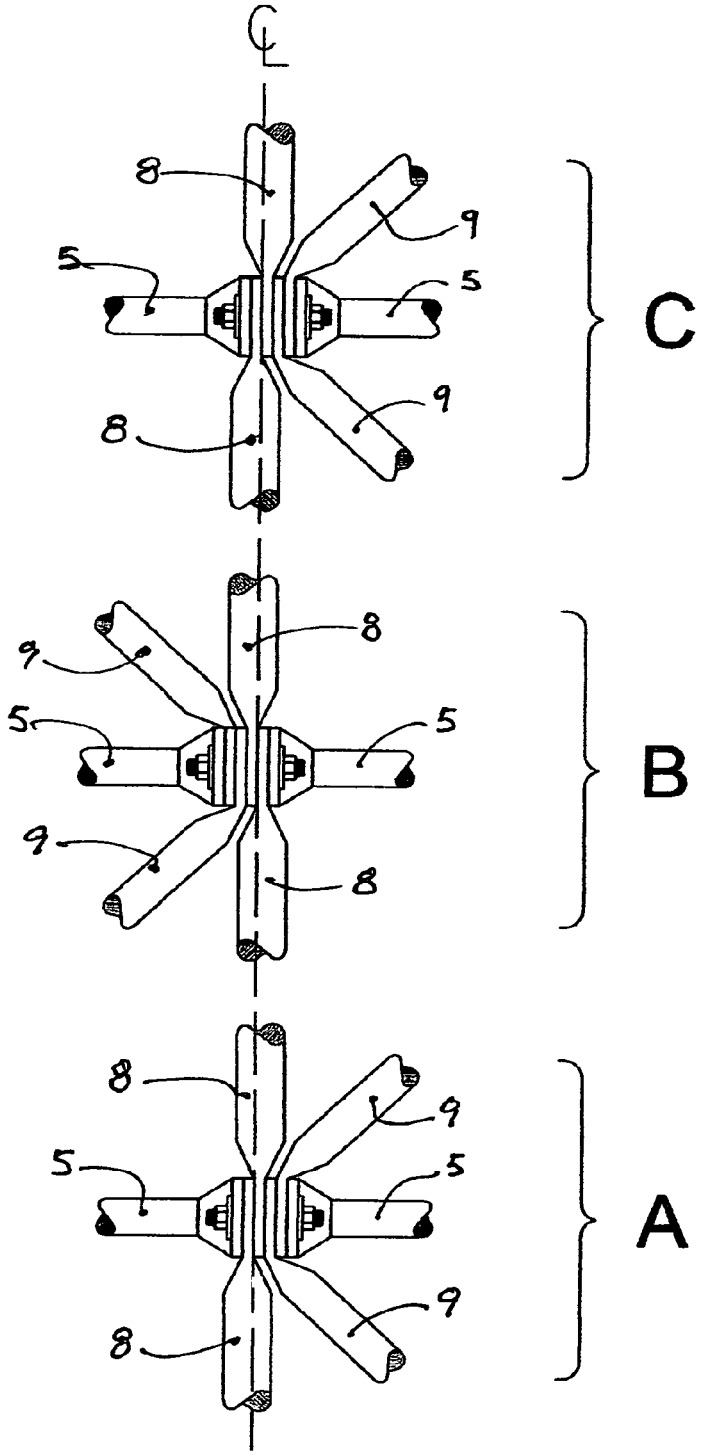
FIG. 8 includes a center line (CL) defined to illustrate the staggered and alternate location of the vertical tubular leg members 8 which are placed staggered, alternating from left to right of a CL at nodes, marked A, B and C. At node A, a number 8 vertical leg member, coming from a lower level, reaches node A at the left of the CL, and its adjacent vertical leg member 8 going upward is placed to the right of the CL and is connected at the above node B, to the right of the CL. Then, at node B, the vertical leg member 8 that connects to the upper level at node C is placed at the left of the CL connecting to the upper level node C at the left of the CL. This procedure provides the verticality of the connected tubular leg member's number 8 of the tower.
Figure 9:
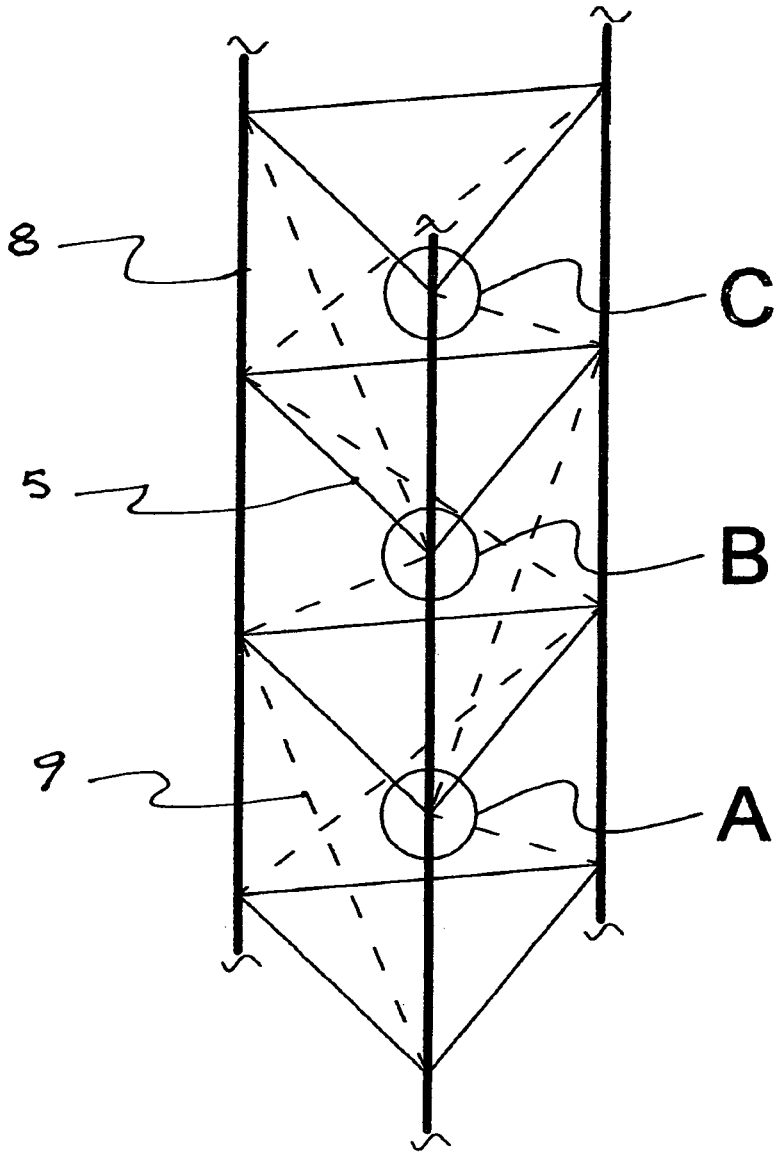
FIG. 9 is an isometric view of a section of the tower to better illustrate the interconnection of members and nodes. In this FIG. 9 the thick black lines represent the number 8 vertical tubular leg members, the thin black line represent the horizontal number 5 members with their flattened and pierced holes end bended 30 degree angle which when interconnected conform the equilateral triangle that define a level, and the dashed lines represent the diagonal members that connect lower oppose nodes with upper oppose nodes in a zigzagging fashion on all three faces of the tower to provide lateral anti-torsion stability. Nodes A, B and C, are also shown on FIG. 8.

The erection sequence is as follows:

Once the reinforce concrete base FIG. 7. and anchor stainless steel bolts #13 are in place, the prefabricated tetrahedral elements forming the tower base are interconnected as described in the previous Nodes explanations and figures. First the horizontal tubular elements are connected to the anchor bolts #13 placing them on top of the stainless steel bearing plate #15 and using leveling washers #14 where needed to assure that the nine (9) horizontal elements #7 are leveled. Next the nine (9) diagonal elements of the tetrahedron 6*a*,6*b*,6*c* are also connected to the nine (9) anchor bolts. These diagonals tetrahedral leg elements are placed over the horizontal elements using a clock wise mode (see Node 3), first the diagonal leg coming from the right and on top of the diagonal coming from the left. Once all nine (9) diagonal legs 6*a*, 6*b*, 6*c* are in place they are interconnected at layer "A" as shown on FIG. 3.1 Node one (1). The vertical leg elements of the tower #8 and the diagonal anti-torsion lateral elements #9 shown on Node one (1), FIG. 3.1 going toward the upper level, are placed with the exact direction toward their final position on the upper level before tightening the nuts; this is to assure that they reach Node 4 in FIG. 3.4, on the upper level, in the correct position to allow joining all other elements of the upper Node 4 without needing to loosen nuts on the lower level. This procedure will allow to place the erection platform #18 on top of a secure three horizontal bracing elements #5 located on the lower level for erection crew to stand on and finalize connections on the upper level (see FIG. 6). It is of great importance to connect the anti-rotation diagonal members #9 in a zigzagging manner in all three faces of the tower to assure lateral stability as shown on FIG. 1. This procedure is repeated until the tower reaches its final height. It is important to interconnect the tubular element in all Nodes 4 FIG. 3.4 using the same sequence to assure verticality; in other words, the two vertical elements one coming from the lower level and the other going up to the upper level at the center of the Node, braced by the two anti-torsion diagonals #9 and finally braced by the two horizontal bracings #5 as shown on FIG. 3.4. It is very important to place the vertical leg elements in a staggered fashion from one level to the next to assure verticality. If required for a specific tower design, a tapered section can be installed in the same way described but with vertical legs 8*a* with a small inward angle to connect with the upper level section having smaller triangular bracing section as shown on FIG. 5.

The invention claimed is:

1. A self-supporting three legged communication tower that does not require guy wires to maintain the tower in a vertical position comprising a plurality of tubular members, each tubular member having a flattened end portion, each end portion having a pierced hole to accommodate a stud that can join and connect together each end portion with tightening washers and nuts; six of said plurality of tubular members create a first node; wherein said six tubular members are interconnected in a way that two of the six members extend horizontally with flattened ends bent at a 30 degree angle are embracing the other four members with flattened and pierced holes ends; wherein two of the other four members are vertical leg members that conform the vertical leg of the tower, one extending downwardly toward a lower adjacent node and the other vertical leg member extending upwardly toward an upper adjacent node; the other two tubular members of the embraced four members, are diagonal members that conform a zigzagging lateral anti-rotation brazing of the tower, one diagonal member coming from a lower opposed left node and the other diagonal member extending upwardly toward an upper opposed left node; three of the nodes located on a same horizontal level are interconnected by the equal length horizontal members with ends bended at 30 degrees, they form a 60 degree equilateral triangle at each level of the tower and such levels are separated from each other by the vertical leg members in number as required to complete the total height of the tower.

2. The self-supporting three legged communication tower of claim 1, the vertical tubular leg members with flattened and pierced holes ends are connected from a respective lower node of a one of the levels to an adjacent respective upper node the level above in a staggered and alternating way; wherein the leg member coming from the respective lower node is located at the left of the vertical leg member extending upwardly; the vertical leg member located at the right of the member that came from the respective lower node will be extended to the adjacent respective upper node located at the upper level reaching it at the right of another vertical leg member which will be extended to another higher level node; thereby a verticality of tubular leg members is achieved maintaining the whole tower in vertical position.

3. The self-supporting three legged communication tower of claim 1, provided with a plurality of the anti-rotation diagonal tubular members connecting nodes in all three faces of the tower in a zigzagging pattern vertically along the height of the tower connecting vertically adjacent levels of the tower, pattern repeats from node to node along all three faces of the tower providing anti-rotation and lateral stability to the tower.

4. The self-supporting three legged communication tower of claim 1, capable of being erected in-situ by one installer working from the interior of the tower, standing on a removable platform placed on top of the three horizontal leveled members that conform a respective equilateral triangle of a respective level; further capable of being erected by hand holding the tubular members and connecting them with studs, washers and nuts to form a respective node; once three nodes of a respective level are interconnected the tower level is finished and the platform is removable for placement on a respective immediate upper level to connect the respective immediate upper level and repeat the steps until a highest level is reached, so as to complete the installation of the tower.

5. The self-supporting three legged communication tower of claim 1, wherein three respective nodes of a lowest level are placed and connected to a top vertices of a three tetrahedral structure made up of the tubular members with ends flattened and pierced; wherein six nodes at the base of the three tetrahedral structure are connected to six anchor bolts imbedded in a concrete foundation of dimensions required to assure stability of the tower.

6. The self-supporting three legged communication tower of claim 1, provided with tapered sections along the length of the tower in a quantity as required for a given height design, the tapered sections are conformed by connecting three nodes of a given equilateral triangle of a lower level with a smaller equilateral triangle of an upper level by three of the vertical leg members which are placed slightly at an inward angle in order to reach the smaller upper level equilateral triangle, thereby forming a respective tapered section.

* * * * *